US010256060B2

(12) United States Patent
Terada et al.

(10) Patent No.: US 10,256,060 B2
(45) Date of Patent: Apr. 9, 2019

(54) GAS CIRCUIT BREAKER

(71) Applicant: Hitachi, Ltd., Chiyoda-ku, Tokyo (JP)

(72) Inventors: Masanao Terada, Tokyo (JP); Taichiro Yamashita, Tokyo (JP); Hiroaki Hashimoto, Tokyo (JP); Hajime Urai, Tokyo (JP); Makoto Hirose, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/846,936

(22) Filed: Dec. 19, 2017

(65) Prior Publication Data

US 2018/0182578 A1 Jun. 28, 2018

(30) Foreign Application Priority Data

Dec. 27, 2016 (JP) ..... 2016-252257

(51) Int. Cl.
*H01H 33/42* (2006.01)
*H01H 33/56* (2006.01)

(52) U.S. Cl.
CPC ..... *H01H 33/42* (2013.01); *H01H 33/565* (2013.01)

(58) Field of Classification Search
CPC ..... H01H 33/42; H01H 33/565
See application file for complete search history.

(56) References Cited

U.S. PATENT DOCUMENTS 3,919,511 A * 11/1975 Noack ..... H01H 33/42 218/43
6,271,494 B1 8/2001 Dienemann et al.
6,342,685 B1 1/2002 Perret
6,365,863 B1 * 4/2002 Marin ..... H01H 33/42 218/154
2009/0266795 A1 * 10/2009 Kriegel ..... H01H 33/904 218/154

(Continued)

FOREIGN PATENT DOCUMENTS

EP 0 564 058 A1 10/1993
JP 2003-109480 A 4/2003

*Primary Examiner* — Truc Nguyen
(74) *Attorney, Agent, or Firm* — Crowell & Moring LLP

(57) ABSTRACT

Realized is a shape of a grooved cam that maximizes break performance by appropriately setting an electrode operation, with a minimum weight increase. A gas circuit breaker includes a drive side electrode and a driven side electrode which are disposed to face each other in a sealed tank, the drive side electrode having a drive side main electrode and a drive side arcing contact, the driven side electrode having a driven side main electrode and a driven side arcing contact, the drive side arcing contact being connected to an operating device, and the driven side arcing contact being connected to a double motion mechanism portion, in which the double motion mechanism portion includes a drive side connection rod that receives driving force from the drive side electrode, a driven side connection rod that is connected to the driven side arcing contact, a lever that is bent to the operating device side around a rotation axis by causing the driven side connection rod to operate in an opposite direction with respect to an operation of the drive side connection rod, and a guide that defines operations of the drive side connection rod and the driven side connection rod.

18 Claims, 8 Drawing Sheets

(56) References Cited

U.S. PATENT DOCUMENTS

| | | | | |
|---|---|---|---|---|
| 2012/0103940 | A1* | 5/2012 | Ohda | H01H 33/166<br>218/50 |
| 2015/0162149 | A1* | 6/2015 | Krehnke | H01H 33/42<br>218/14 |
| 2015/0371796 | A1* | 12/2015 | Cernat | H01H 33/123<br>218/146 |
| 2017/0278654 | A1* | 9/2017 | Terada | H01H 33/42 |

* cited by examiner

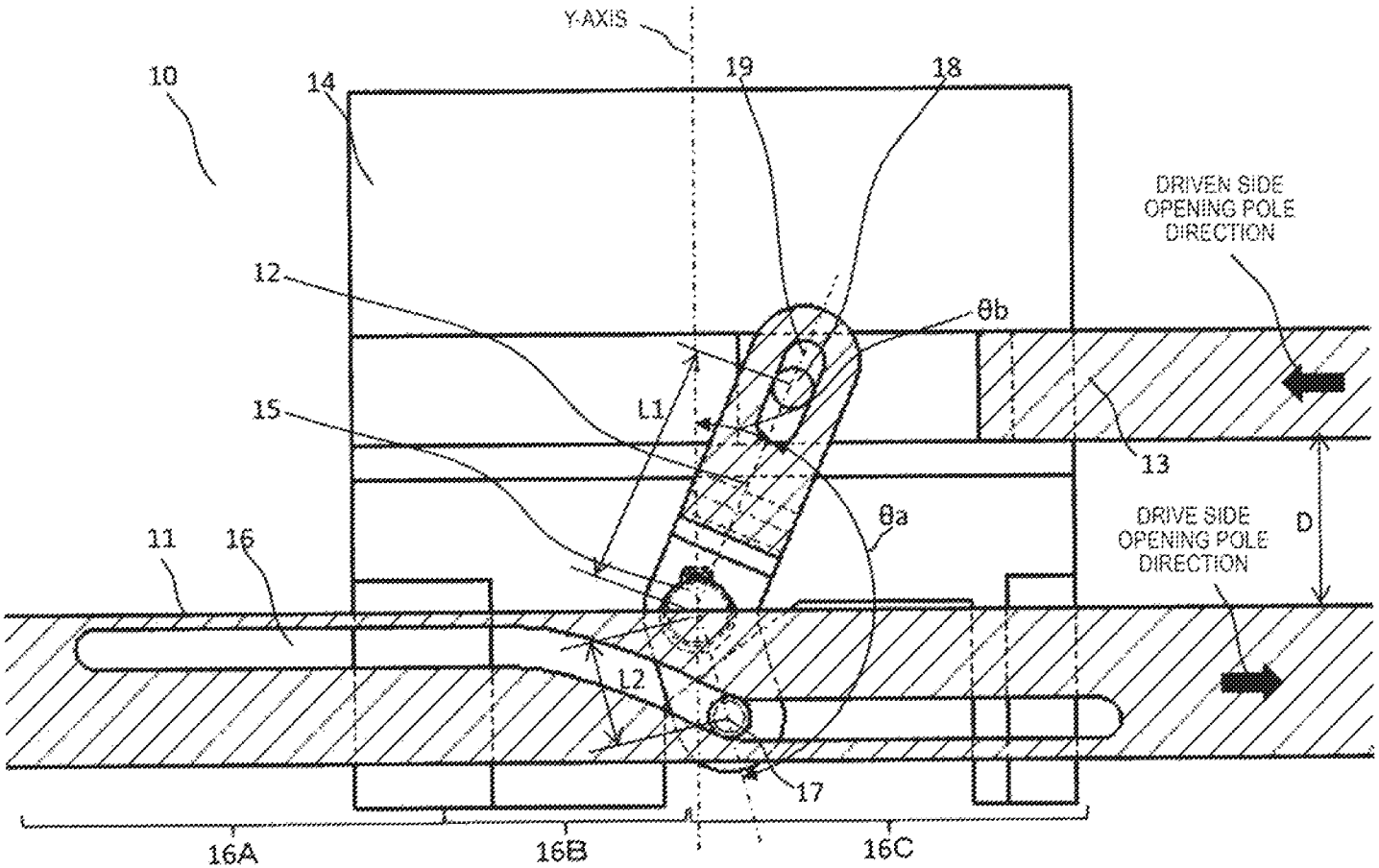
[Fig. 1]

[Fig. 2]
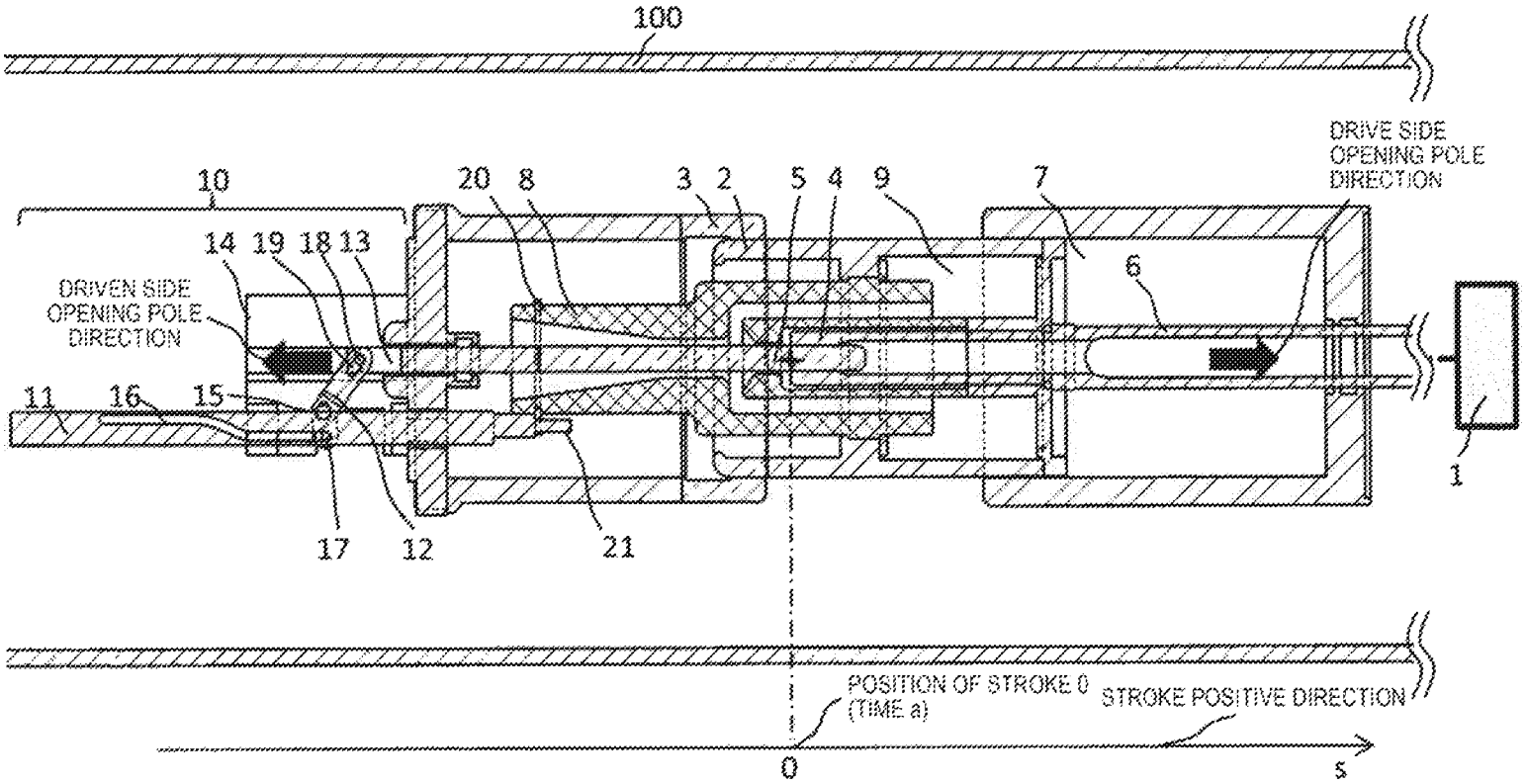

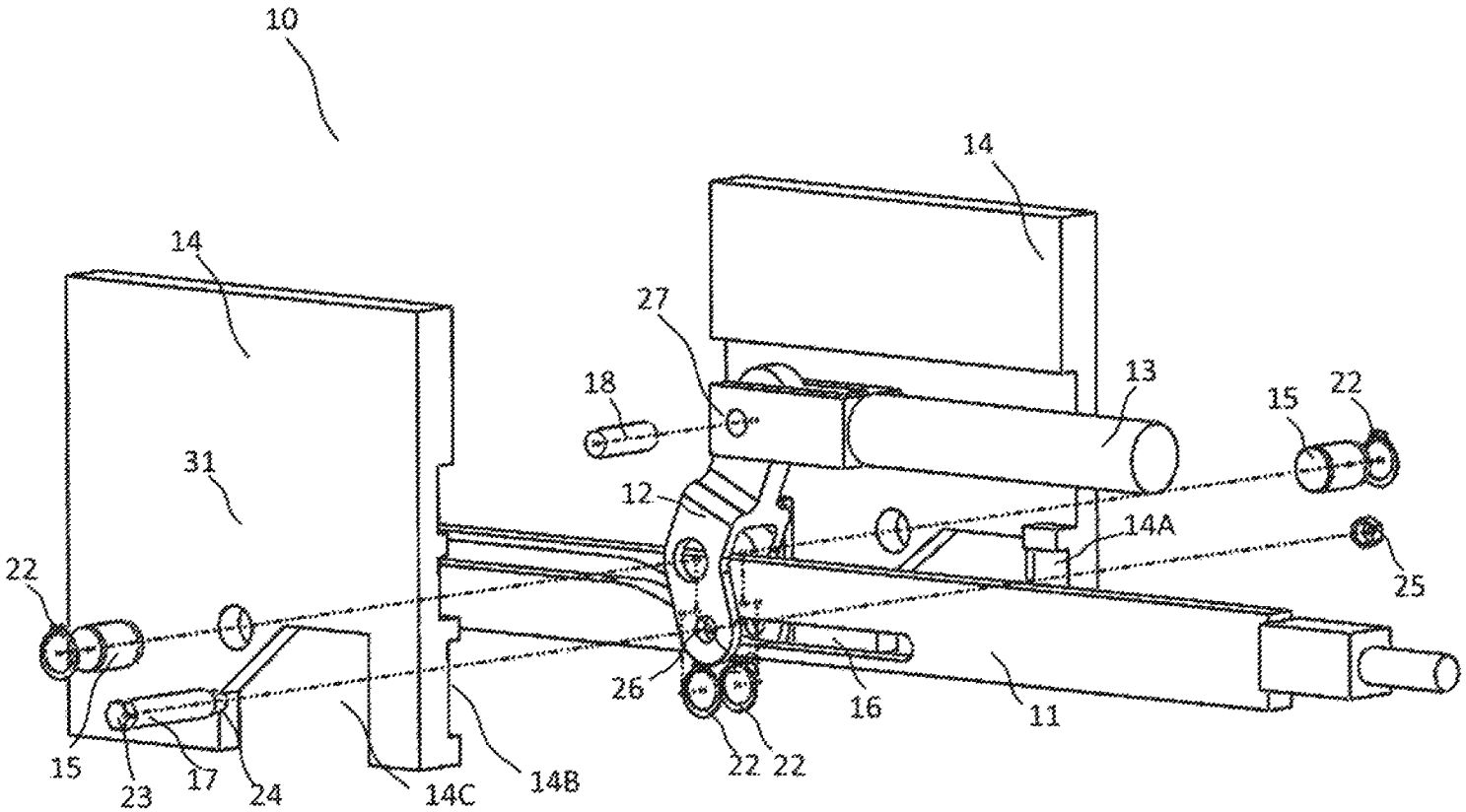
[Fig. 3]

[Fig. 4]
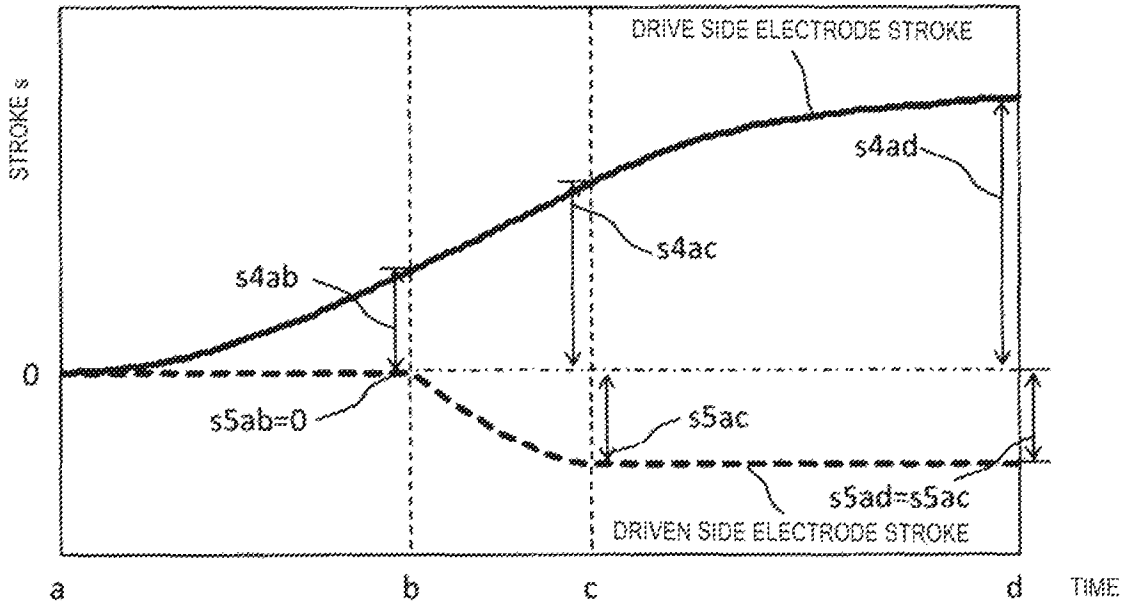

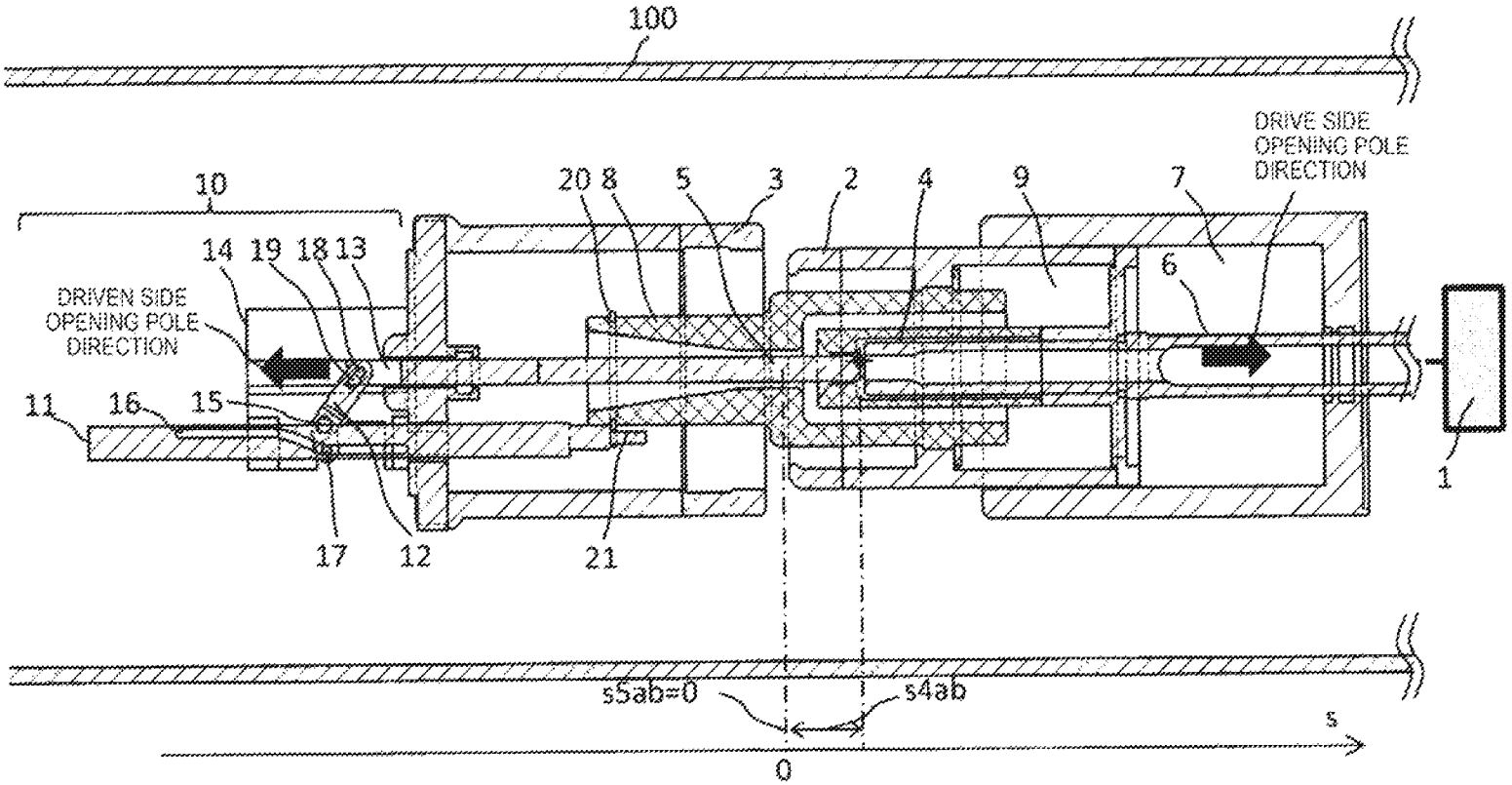
[Fig. 5]

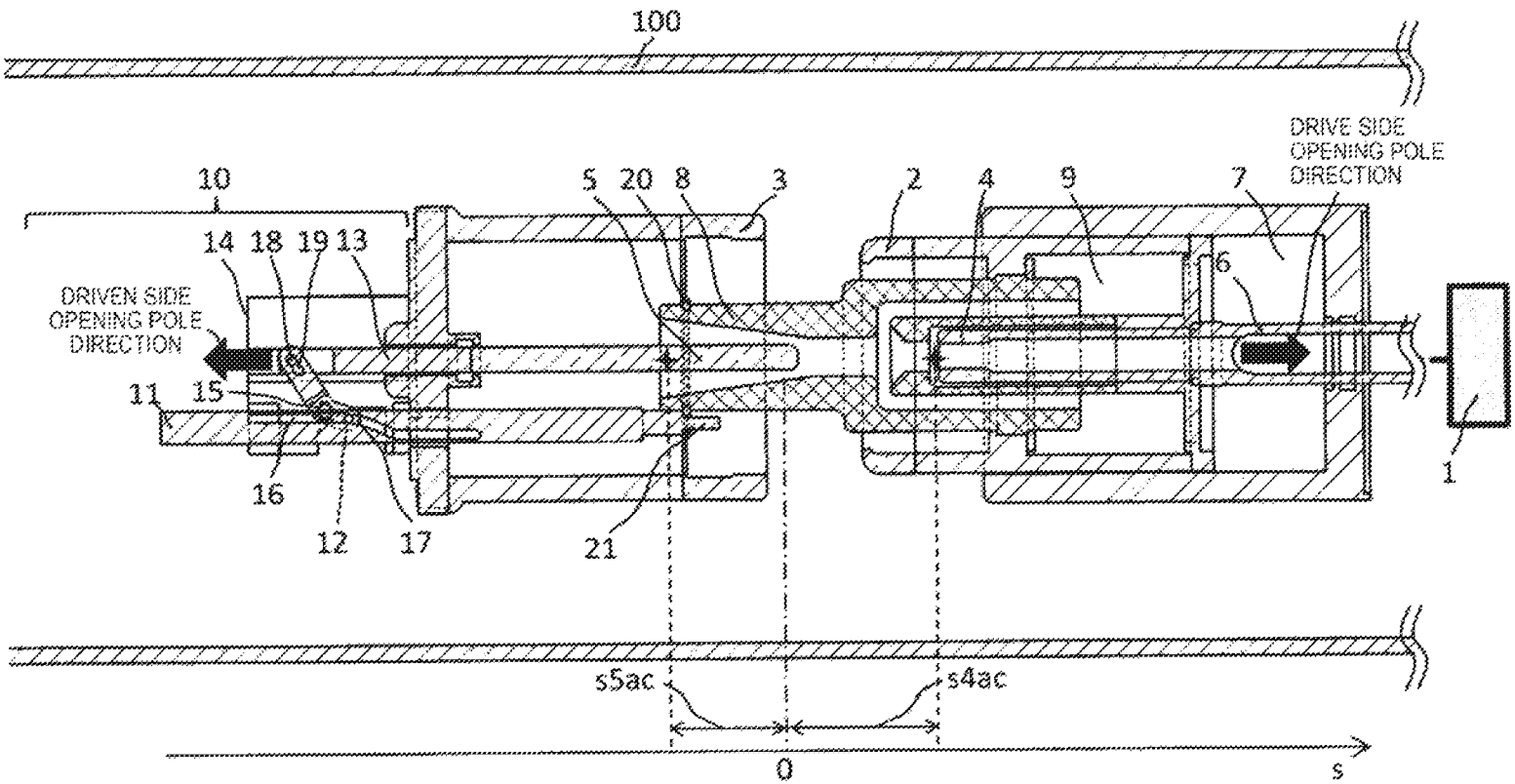
[Fig. 6]

[Fig. 7]
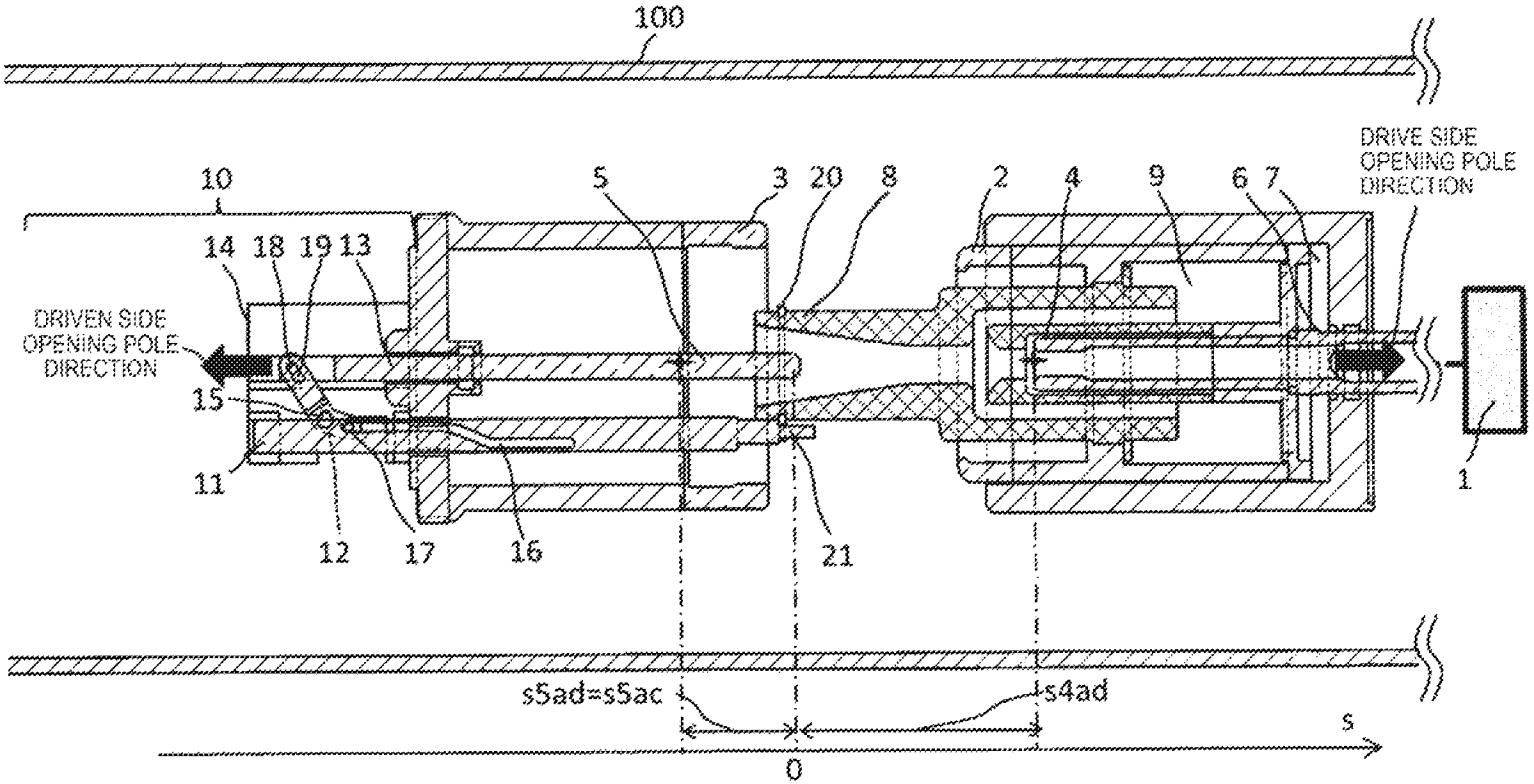

[Fig. 8]
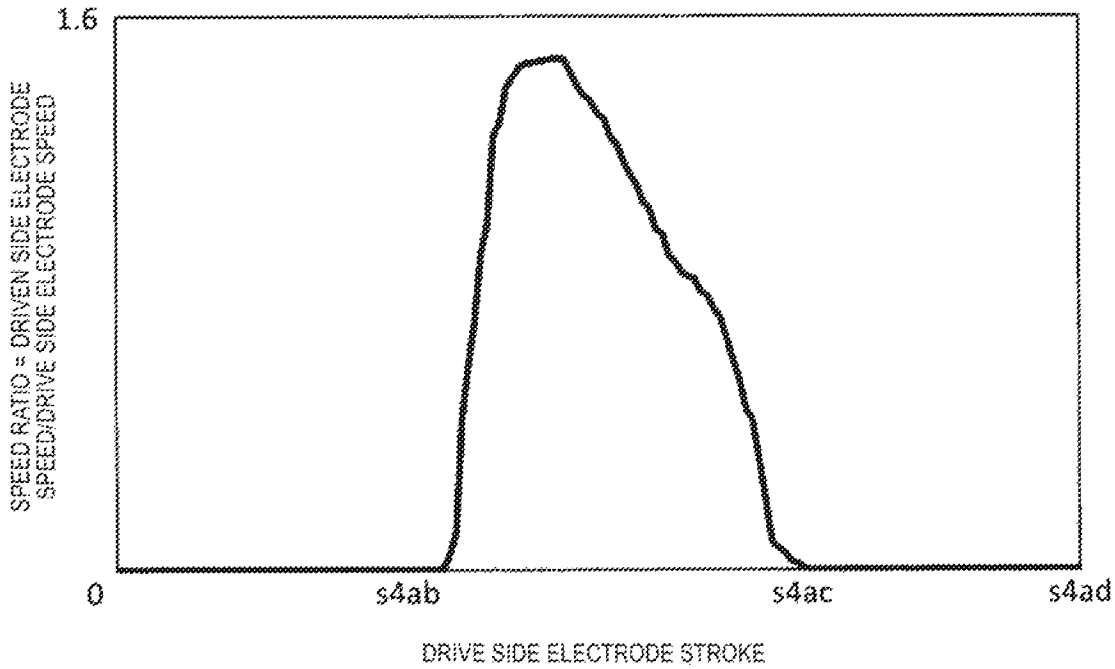

GAS CIRCUIT BREAKER

TECHNICAL FIELD

The present invention relates to a gas circuit breaker to which a double motion mechanism that drives electrodes in directions opposite to each other is applied.

BACKGROUND ART

In a gas circuit breaker which is used for an electrical power system of a high voltage, a so-called puffer type that breaks an electrical current by using an increase of an arc extinction gas pressure in the middle of an opening pole operation and spraying a compressed gas to an arc generated between electrodes, is generally used.

In order to reduce operating force (cost) while maintaining break performance of the puffer type gas circuit breaker, a drive method in which a relative deviation speed between the electrodes facing each other is made large, has been proposed.

In PTL 1, a drive method in which only an operation section necessary to break only an electrode is accelerated in a movable component connected to a drive source, is proposed. This is a drive method in which a lever is moved together with a movable portion along a fixed grooved cam, and is rotationally moved along a grooved cam curved surface in the operation necessary section, and the electrode is accelerated in the same direction as a drive direction.

In PTL 2, a drive method (double motion method) in which a fixed electrode (driven side) of the related art that is disposed to face a movable portion (drive side) connected to a drive source operates in an opposite direction to a drive direction, is proposed. This is a drive method in which a fork type lever of which a rotation axis is fixed onto a pin working coupled with a movement of the movable portion is rotationally moved, and a counter electrode is accelerated in the opposite direction to the drive direction.

CITATION LIST

Patent Literature

PTL 1: JP-A-2003-109480
PTL 2: U.S. Pat. No. 6,271,494

SUMMARY OF INVENTION

Technical Problem

In the method of being moved in the same direction as the drive direction described in PTL 1, since the grooved cam is used, it is possible to appropriately set an electrode position at each time in the operation section in accordance with the break performance, but weight is increased since there is a need to attach a drive mechanism of electrode acceleration to the movable portion, and it is not possible to make the operating force of the drive source sufficiently small.

In the method described in PTL 2, since a drive mechanism is fixed independently from the movable portion, it is possible to make the operating force of the drive source sufficiently small by preventing a weight increase of the movable portion to be minimum, but it is not possible to appropriately set the position of the driven side electrode at each time since a shape of the fork type lever is configured only with a straight line portion and a circular arc portion.

Solution to Problem

In order to solve the problems described above, the invention provides a gas circuit breaker including a drive side electrode and a driven side electrode which are disposed to face each other in a sealed tank, the drive side electrode having a drive side main electrode and a drive side arcing contact, the driven side electrode having a driven side main electrode and a driven side arcing contact, the drive side arcing contact being connected to an operating device, and the driven side arcing contact being connected to a double motion mechanism portion, in which the double motion mechanism portion includes a drive side connection rod that receives driving force from the drive side electrode, a driven side connection rod that is connected to the driven side arcing contact, a lever that bends the driven side connection rod to the operating device side around a rotation axis by causing the driven side connection rod to operate in an opposite direction with respect to an operation of the drive side connection rod, and a guide that defines operations of the drive side connection rod and the driven side connection rod, and the lever is rotationally moved, the driven side connection rod is driven in a direction which is opposite to the drive side connection rod, and the driven side arcing contact that is connected to the driven side connection rod is driven in a direction which is opposite to the drive side arcing contact of the drive side electrode that is connected to the drive side connection rod, by causing a movable pin to communicate with a grooved cam that is included in the drive side connection rod and a pin communication portion that is disposed in the guide, and moving the movable pin in the grooved cam due to the operation of the drive side connection rod.

Advantageous Effects of Invention

According to the configuration described above, it is possible to realize a shape of a grooved cam that maximizes break performance by appropriately setting an electrode operation, with a minimum weight increase, and a drive mechanism onto which the same is mounted.

It is possible to make displacement of an opening-closing axis direction large due to a rotation, by bending the lever to the operating device side around the rotation axis, and in a case where a stroke length of the driven side is the same as in the related art, it is possible to make a width of a direction which is perpendicular to an opening-closing axis small.

As described above, according to the invention, it is possible to realize the shape of the grooved cam to minimize energy of the operating device while securing the break performance, and it is possible to make operation energy small in comparison with the drive method of the related art. Since it is possible to relieve excessive force acting on the movable pin, it is possible to realize a double motion mechanism of high reliability.

BRIEF DESCRIPTION OF DRAWINGS

FIG. 1 is a detailed diagram illustrating a state immediately before an operation of a driven side electrode in the middle of opening pole of a double motion mechanism in a gas circuit breaker according to Example 1.

FIG. 2 is a diagram illustrating a closing pole state of the gas circuit breaker according to Example 1.

FIG. 3 is an exploded perspective view of the double motion mechanism in the gas circuit breaker according to Example 1.

FIG. 4 is a diagram illustrating stroke properties of the gas circuit breaker according to Example 1.

FIG. 5 is a diagram illustrating a state immediately before an operation of a driven side arcing contact, in the middle of opening pole of the gas circuit breaker according to Example 1.

FIG. 6 is a diagram illustrating an end state of the operation of the driven side arcing contact, in the middle of opening pole of the gas circuit breaker according to Example 1.

FIG. 7 is a diagram illustrating an opening pole state of the gas circuit breaker according to Example 1.

FIG. 8 is a diagram illustrating a speed ratio of a drive side arcing contact and the driven side arcing contact in the gas circuit breaker according to Example 1.

DESCRIPTION OF EMBODIMENTS

Hereinafter, a gas circuit breaker according to an embodiment of the invention will be described with reference to the drawings. The following description is merely an example, and does not have a purpose for intending to limit contents of the invention to specific aspects described below. It is possible to carry out the invention itself in various aspects in conformity with the contents described in the scope of the claims. In the following example, a breaker having a mechanical compression chamber and a thermal expansion chamber will be described by being used as an example, but for example, it is possible to apply the invention of the present specification to the breaker having only the mechanical compression chamber.

Example 1

FIG. 2 illustrates an input state of a gas circuit breaker in Example 1.

A drive side electrode and a driven side electrode are disposed to coaxially face each other in a sealed tank 100. A drive side electrode has a drive side main electrode 2 and a drive side arcing contact 4, and the driven side electrode has a driven side main electrode 3 and a driven side arcing contact 5.

An operating device 1 is disposed by being adjacent to the sealed tank 100. A shaft 6 is connected to the operating device 1, and the drive side arcing contact 4 is disposed at a tip of the shaft 6. The shaft 6 and the drive side arcing contact 4 are disposed by passing through a mechanical compression chamber 7 and a thermal expansion chamber 9.

The drive side main electrode 2 and a nozzle 8 are disposed on a break portion side of the thermal expansion chamber 9. The driven side arcing contact 5 is disposed on the same axis by facing the drive side arcing contact 4. One end of the driven side arcing contact 5, and a tip portion of the nozzle 8 are connected to a double motion mechanism portion 10.

As illustrated in FIG. 2, the gas circuit breaker is set at a position where the drive side main electrode 2 and the driven side main electrode 3 are made to be conductive by a drive source due to an oil pressure or a spring of the operating device 1 in the input state, and configures a circuit of an electric power system of normal time.

When a short circuit current due to lightning or the like is broken, the operating device 1 is driven in an opening pole direction, and the drive side main electrode 2 and the driven side main electrode 3 are separated through the shaft 6. At that time, an arc is generated between the drive side arcing contact 4 and the driven side arcing contact 5. The arc is extinguished by spraying a mechanical arc extinction gas with the mechanical compression chamber 7, and spraying an arc extinction gas by using arc heat with the thermal expansion chamber 9, thereby, an electrical current is broken.

In order to reduce operation energy of such a puffer type gas circuit breaker, a double motion mechanism portion 10 that drives the driven side arcing contact which is fixed as before in an opposite direction to a drive direction of the drive side electrode, is disposed. Hereinafter, a double motion method in Example 1 will be described, based on FIG. 1, FIG. 3, and FIG. 4.

As illustrated in FIG. 1 and FIG. 3, the double motion mechanism portion 10 of Example is configured by connecting a driven side connection rod 13 and a drive side connection rod 11 to a lever 12 which is disposed to be freely rotationally moved in a guide 14, while retaining the driven side connection rod 13 and the drive side connection rod 11 to be freely moved in a break operation direction by the guide 14.

A grooved cam 16 is cut into the drive side connection rod 11, and is configured with a second straight line portion 16C, a connecting portion 16B, and a first straight line portion 16A, when viewed from an operating device side. The first straight line portion 16A and the second straight line portion 16C are disposed on axis lines which are different from each other, and the connecting portion 16B is disposed therebetween. It is possible to arbitrarily design a shape of the connecting portion 16B in accordance with operation properties of the break portion, and for example, it is conceivable to make a curve or a straight line.

In the drive side connection rod 11, displacement of up and down directions is limited by a groove which is disposed in the guide 14 (see groove 14A and groove 14B in FIG. 3), and the movement is possible only in a direction which is horizontal to an operation axis of the break portion.

A drive side movable pin 17 communicates with a circular hole 26 and the grooved cam 16 which are cut into the lever 12. At this time, a guide notch portion 14C is disposed, thereby, interference between the drive side movable pin 17 and the guide 14 is prevented. The guide notch portion 14C may be a communicating hole that covers a movable range of the drive side movable pin 17. By making the communicating hole, it is possible to enhance mechanical strength of the guide 14. The lever 12 has a circular hole 27, and a driven side movable pin 18 communicates with the lever 12 and the driven side connection rod 13. The drive side movable pin 17 fastens a drive side movable pin fastening screw 24 with a drive side movable pin fixing nut 25 by using a drive side movable pin hexagon head 23.

The drive side movable pin 17 is moved in the grooved cam 16 of the drive side connection rod 11, thereby, the lever 12 rotates by using a lever fixing pin 15 as a rotation axis. By the rotational movement, a lever driven side guide groove 19 which is cut into the lever 12 transmits force to the driven side movable pin 18 which is attached to the driven side connection rod 13, thereby, the driven side connection rod 13 which is connected to the driven side arcing contact 5 is driven in a direction which is opposite to the drive side connection rod 11.

For example, the connection of the double motion mechanism portion 10 and the drive side has a structure in which a fastening ring 20 is attached to the nozzle 8, a hole passing through the tip portion of the drive side connection rod 11 is disposed in the fastening ring 20, and a drive side fastening screw 21 is fastened with the nut.

The lever fixing pin 15 may be configured by one member to pass through the guide 14 and the lever 12, but as illustrated in FIG. 3, it is desirable to make a configuration in which the lever fixing pin 15 is disposed as two members respectively at both ends of the guide 14, and the lever 12 is retained to be freely rotationally moved from both sides. In order not to detach the lever fixing pin 15 from the guide 14, for example, a lever fixing pin snap ring 22 is fit into the grooves which are respectively cut into at both ends of the pin, thereby, the realization thereof is possible. By making such a configuration, it is possible to design the lever fixing pin 15 without concern of the interference with the drive side connection rod 11, thereby, degrees of freedom in design are enhanced.

The lever 12 is bent to the operating device side at an angle θa which is 90 degrees or more and less than 180 degrees. The angle θa is set such that a ratio L1/L2 of a driven side arm length L1 and a drive side arm length L2 is made as small as possible for the purpose of enhancing transmission efficiency of the force, and an interval D between the drive side connection rod and the driven side connection rod is made as small as possible in order to be tightly fit into the breaker. An angle θb of the straight line obtained by binding a Y-axis, the lever fixing pin 15, and the driven side movable pin 18 is desirable to be set such that the driven side arm length L1 is made as small as possible, and the angle is equal with respect to the Y-axis at the time of starting and ending the rotational movement of the lever.

In a state immediately before the operation of the driven side arcing contact 5 illustrated in FIG. 1, the arm length of the drive side is positioned on the operating device 1 side with respect to the Y-axis (θc_1>0), and in an end state of the operation of the driven side arcing contact 5 illustrated in FIG. 6, the arm length of the drive side is positioned on the drive side connection rod 11 side with respect to an X-axis (θc_2>0). This is because rotating force of one direction is applied to the lever 12 at all times by the force which is received from a surface of the grooved cam 16 when the drive side movable pin 17 moves the connecting portion 16B of the grooved cam 16.

In order not to apply the force in a direction which is perpendicular to the opening pole direction, it is desirable that the lever 12 is made in a bilaterally symmetrical shape. Therefore, in Example, a structure of cutting out a lower portion of the lever to sandwich the drive side connection rod 11, is made.

Hereinafter, the description will be made per state in the middle of the opening pole operation, by using FIG. 4 to FIG. 7.

FIG. 4 is a diagram in which a horizontal axis indicates time, and a vertical axis indicates a drive side electrode stroke and a driven side electrode stroke. Time a is time of an opening pole start, and time b is time immediately before the operation of the driven side arcing contact 5 (state of FIG. 5). Time c is time of an operation end of the driven side arcing contact 5 (state of FIG. 6). Time d is time at which the drive side operation is completed, and the state reaches to an opening pole state (state of FIG. 7). The stroke of both electrodes at each time, for example, the stroke from the time a to the time b of the drive side arcing contact 4 is represented by s4ab.

FIG. 5 is a diagram illustrating a state immediately before the operation of the driven side arcing contact 5. In the stroke from time a to time b, the drive side arcing contact 4 is s4ab (≠0), the driven side arcing contact 5 is s5ab (=0), and the driven side arcing contact 5 is stopped. That is, the state where the driven side arcing contact 5 is stopped while the straight line portion of the second straight line portion 16C of the grooved cam passes through the drive side movable pin 17, is realized (the state is referred to as an intermittent drive, hereinafter). In other words, by adjusting the length of the second straight line portion 16C, it is possible to move the driven side only in an arbitrary time domain.

FIG. 6 is a diagram illustrating an end state of the operation of the driven side arcing contact 5. In the stroke from time a to time c, the drive side arcing contact 4 is s4ac (>s4ab), the driven side arcing contact 5 is s5ac (>s5ab), and both electrodes are moved. At this time, the drive side movable pin 17 approaches the first straight line portion 16A of the grooved cam.

FIG. 7 is a diagram illustrating the opening pole state. In the stroke from time a to time d, the drive side arcing contact 4 is s4ad (>s4ac), the driven side arcing contact 5 is s5ad (=s5ac), and the driven side arcing contact 5 is stopped. The intermittent drive state where the driven side arcing contact 5 is stopped while the first straight line portion 16A of the grooved cam passes through the drive side movable pin 17, is realized.

As described above, the drive side movable pin 17 is moved in the grooved cam by the connecting portion 16B of the grooved cam, thereby, the driven side arcing contact 5 is driven in the opposite direction to the opening pole direction by rotationally moving the lever 12, and the operation of the drive side movable pin 17 is limited by the first straight line portion 16A and the second straight line portion 16C of the grooved cam 16, thereby, the intermittent drive state where the driven side arcing contact 5 is stopped, is made.

As Example, the bending angle θa of the lever 12 is set to be equal to a deflection angle of the lever 12 with respect to an opening-closing operation axis which is perpendicular to an opening-closing axis, thereby, it is possible to realize the space-saving double motion mechanism.

FIG. 8 is a diagram in which the horizontal axis indicates the stroke of the drive side arcing contact 4, and the vertical axis indicates a speed ratio of the driven side arcing contact 5 to the drive side arcing contact 4. In Example, when the drive side arcing contact 4 reaches the stroke s4ab, the driven side arcing contact 5 starts to move, and the driven side arcing contact 5 stops at s4ac. A rise is made sudden acceleration, and deceleration is made at two-step. This is because a distance between the electrodes is made long in a short time, by sharply accelerating the driven side arcing contact 5 from time b (see FIG. 4) at which the driven side arcing contact 5 cuts through the drive side arcing contact 4.

Such an operation is particularly effective for the break of the small progress electrical current. In the break of the small progress electrical current, there is a need that a dielectric breakdown voltage between the electrodes at each time of the break surpasses a recovery voltage. This is because there is a need to earn the distance between the electrodes as much as possible in a short time since the dielectric breakdown voltage between the electrodes depends on the distance between the electrodes at each time.

In Example, the shape of the grooved cam of the double motion mechanism that can realize stroke properties which are necessary to break the small progress electrical current is illustrated, but there are the most suitable stroke properties with respect to various break duties, and it is possible to realize the stroke properties by changing the shape of the connecting portion 16B which is configured with an arbitrary curve of Example.

REFERENCE SIGNS LIST

1: OPERATING DEVICE
2: DRIVE SIDE MAIN ELECTRODE

3: DRIVEN SIDE MAIN ELECTRODE
4: DRIVE SIDE ARCING CONTACT
5: DRIVEN SIDE ARCING CONTACT
6: SHAFT
7: MECHANICAL COMPRESSION CHAMBER
8: NOZZLE
9: THERMAL EXPANSION CHAMBER
10: DOUBLE MOTION MECHANISM PORTION
11: DRIVE SIDE CONNECTION ROD
12: LEVER
13: DRIVEN SIDE CONNECTION ROD
14: GUIDE
14C: GUIDE NOTCH PORTION
15: LEVER FIXING PIN
16: GROOVED CAM
16A: FIRST STRAIGHT LINE PORTION
16B: CONNECTING PORTION
16C: SECOND STRAIGHT LINE PORTION
17: DRIVE SIDE MOVABLE PIN
18: DRIVEN SIDE MOVABLE PIN
19: LEVER DRIVEN SIDE GUIDE GROOVE
20: FASTENING RING
21: DRIVE SIDE FASTENING SCREW
22: LEVER FIXING PIN SNAP RING
23: DRIVE SIDE MOVABLE PIN HEXAGON HEAD
24: DRIVE SIDE MOVABLE PIN FASTENING SCREW
25: DRIVE SIDE MOVABLE PIN FIXING NUT
26: CIRCULAR HOLE
27: CIRCULAR HOLE
100: SEALED TANK
L1: DRIVEN SIDE ARM LENGTH
L2: DRIVE SIDE ARM LENGTH

The invention claimed is:

1. A gas circuit breaker comprising:

a drive side electrode and a driven side electrode which are disposed to face each other in a sealed tank, the drive side electrode having a drive side main electrode and a drive side arcing contact, the driven side electrode having a driven side main electrode and a driven side arcing contact, the drive side arcing contact being connected to an operating device, and the driven side arcing contact being connected to a double motion mechanism portion, wherein the double motion mechanism portion includes a drive side connection rod that receives driving force from the drive side electrode, a driven side connection rod that is connected to the driven side arcing contact, a lever that is bent to the operating device side around a rotation axis by causing the driven side connection rod to operate in an opposite direction with respect to an operation of the drive side connection rod, and a guide that defines operations of the drive side connection rod and the driven side connection rod, and the lever is rotationally moved, the driven side connection rod is driven in a direction which is opposite to the drive side connection rod, and the driven side arcing contact that is connected to the driven side connection rod is driven in a direction which is opposite to the drive side arcing contact of the drive side electrode that is connected to the drive side connection rod, by causing a movable pin to communicate with a grooved cam that is included in the drive side connection rod and a pin communication portion that is disposed in the guide, and moving the movable pin in the grooved cam due to the operation of the drive side connection rod.

2. The gas circuit breaker according to claim 1, wherein the grooved cam is configured with a first straight line portion, a second straight line portion that is disposed on an axis which is different from the first straight line portion, and a connecting portion that connects the first straight line portion and the second straight line portion to each other.

3. The gas circuit breaker according to claim 1, wherein the lever is supported to be freely rotationally moved by lever fixing pins which are respectively disposed on both sides of the guide.

4. The gas circuit breaker according to claim 2, wherein the lever is supported to be freely rotationally moved by lever fixing pins which are respectively disposed on both sides of the guide.

5. The gas circuit breaker according to claim 1, wherein an operation angle which is formed by the lever from a start to an end of an opening-closing operation, is substantially the same as an angle with respect to a line that is perpendicular to an opening-closing operation axis passing through a central point of the lever fixing pin.

6. The gas circuit breaker according to claim 2, wherein an operation angle which is formed by the lever from a start to an end of an opening-closing operation, is substantially the same as an angle with respect to a line that is perpendicular to an opening-closing operation axis passing through a central point of the lever fixing pin.

7. The gas circuit breaker according to claim 3, wherein an operation angle which is formed by the lever from a start to an end of an opening-closing operation, is substantially the same as an angle with respect to a line that is perpendicular to an opening-closing operation axis passing through a central point of the lever fixing pin.

8. The gas circuit breaker according to claim 4, wherein an operation angle which is formed by the lever from a start to an end of an opening-closing operation, is substantially the same as an angle with respect to a line that is perpendicular to an opening-closing operation axis passing through a central point of the lever fixing pin.

9. The gas circuit breaker according to claim 1, wherein a central point of the movable pin is positioned on the operating device side with respect to the line that is perpendicular to the opening-closing operation axis passing through the central point of the lever fixing pin.

10. The gas circuit breaker according to claim 2, wherein a central point of the movable pin is positioned on the operating device side with respect to the line that is perpendicular to the opening-closing operation axis passing through the central point of the lever fixing pin.

11. The gas circuit breaker according to claim 1, wherein the central point of the movable pin is positioned on a lower side with respect to the opening-closing operation axis passing through the central point of the lever fixing pin.

12. The gas circuit breaker according to claim 2, wherein the central point of the movable pin is positioned on a lower side with respect to the opening-closing operation axis passing through the central point of the lever fixing pin.

13. The gas circuit breaker according to claim 1, wherein when the movable pin is moved in the first straight line portion and the second straight line portion, the lever is stopped, and when the movable pin is moved in the connecting portion, the lever rotates around a supporting point.

14. The gas circuit breaker according to claim 2, wherein when the movable pin is moved in the first straight line portion and the second straight line portion, the lever is stopped, and when the movable pin is moved in the connecting portion, the lever rotates around a supporting point.

15. The gas circuit breaker according to claim 1, wherein in an opening pole operation, the movable pin is moved on the second straight line portion, the connecting portion, and the first straight line portion in one direction, and in a closing pole operation, the movable pin is moved on the first straight line portion, the connecting portion, and the second straight line portion in one direction.

16. The gas circuit breaker according to claim 2, wherein in an opening pole operation, the movable pin is moved on the second straight line portion, the connecting portion, and the first straight line portion in one direction, and in a closing pole operation, the movable pin is moved on the first straight line portion, the connecting portion, and the second straight line portion in one direction.

17. The gas circuit breaker according to claim 1, wherein a positional relationship of the first straight line portion, the second straight line portion, and the connecting portion of the grooved cam is determined by a speed ratio of a driven side operation to a drive side operation.

18. The gas circuit breaker according to claim 2, wherein a positional relationship of the first straight line portion, the second straight line portion, and the connecting portion of the grooved cam is determined by a speed ratio of a driven side operation to a drive side operation.

* * * * *